United States Patent [19]

Deane et al.

[11] Patent Number: 4,940,099

[45] Date of Patent: Jul. 10, 1990

[54] CUTTING ELEMENTS FOR ROLLER CUTTER DRILL BITS

[75] Inventors: John D. Deane; Craig R. Ivie; Percy W. Schumacher, all of Houston, Tex.

[73] Assignee: Reed Tool Company, Houston, Tex.

[21] Appl. No.: 333,576

[22] Filed: Apr. 5, 1989

[51] Int. Cl.[5] ..... E21B 10/16; E21B 10/50

[52] U.S. Cl. ..... 175/374; 175/378; 175/408; 175/410

[58] Field of Search ..... 175/374, 378, 379, 410, 175/329, 331, 374, 376, 377, 408, 406

[56] References Cited

U.S. PATENT DOCUMENTS

| | | | |
|---|---|---|---|
| 2,027,700 | 1/1936 | Rogatz | 175/378 |
| 2,804,282 | 8/1957 | Spengler, Jr. | 175/378 |
| 3,126,067 | 3/1964 | Schumacher, Jr. | 175/374 |
| 3,311,181 | 3/1967 | Fowler | 175/410 |
| 4,444,281 | 4/1984 | Schumacher, Jr. et al. | 175/336 |
| 4,512,426 | 4/1985 | Bidegaray | 175/329 |
| 4,602,691 | 7/1986 | Weaver | 175/329 |
| 4,690,228 | 9/1987 | Voelz et al. | 175/379 X |
| 4,694,918 | 9/1987 | Hall | 175/329 |
| 4,705,124 | 11/1987 | Abrahamson et al. | 175/410 |
| 4,722,405 | 2/1988 | Langford, Jr. | 175/374 |

FOREIGN PATENT DOCUMENTS

| | | | |
|---|---|---|---|
| 157303 | 12/1963 | U.S.S.R. | 175/374 |
| 279514 | 11/1971 | U.S.S.R. | 175/374 |
| 456885 | 2/1975 | U.S.S.R. | 175/374 |
| 715765 | 2/1980 | U.S.S.R. | 175/374 |

*Primary Examiner*—Hoang C. Dang

*Attorney, Agent, or Firm*—Dodge Bush & Moseley

[57] ABSTRACT

A rotary drill bit (10) having a plurality of roller cutters (20) with rows (32A, 32B, 32C, 32D) of cutting inserts (34,36,38,40) mounted within sockets (35,46) on the frusto-conical cutter body (30). The cutting inserts 34,36,38,40) have cutting surfaces formed with a wear-resistant material with certain cutting inserts (36,38) being formed of a wear-resistant material having a hardness higher than the hardness of the wear-resistant material on the remaining inserts (34,40) in each row. The hard cutting inserts (36,38) are positioned in each row in a predetermined pattern intermingled in a generally uniformly spaced pattern with the softer cutting inserts (34,40) and comprising generally between 20% and 50% of the total number of cutting inserts in a particular row.

2 Claims, 2 Drawing Sheets

CUTTING ELEMENTS FOR ROLLER CUTTER DRILL BITS

BACKGROUND OF THE INVENTION

This invention relates to roller cutter drill bits used primarily in drilling wells for oil, gas, or geothermal energy, and more particularly to the cutting elements used on the roller cutters.

In drilling wells the cutting elements or inserts which fit within sockets in annular rows on the roller cutter body become dull or worn resulting in inefficiency and in many cases resulting in the bits having to be removed from the hole and replaced with new bits. Generally, the prior art has attempted to minimize these problems by fabricating the cutting inserts from abrasion resistant grades of tungsten carbide. The grade of tungsten carbide selected depends on the formation to be cut, and the drilling conditions encountered. Inserts having a high abrasion resistance are typically harder and will have a greater wear life but are more brittle and thus more susceptible to fracture when drilling in hard tough formations, while inserts having a tougher grade of carbide are relatively soft and will have less wear resistance. A compromise is generally made using a grade of tungsten carbide which is as hard as possible but will not fracture when hard tough formations are encountered. As is generally the case, the hard tough formations are encountered only occasionally, usually in a shallow layer or in nodules of formations. This is commonly referred to as hitting a "hard streak". Because of these "hard streaks" in the formations encountered, occasionally a tougher less abrasive resistant cutting insert is generally employed. If it were not for these occasional "hard streaks" a harder more abrasive resistant insert could be used and less insert wear would occur.

The very abrasive formations encountered usually contain a high degree of crystalline silica. If this formation is loosely bonded, such as a weak sandstone, then it is easily fractured and is not prone to cause any insert fracture problems. On the other hand, if it is a cryptocrystalline silica such as chert, and has no distinct grains it is hard and tough to fracture and would be prone to cause insert fracture problems. Fortunately, as mentioned above this type of formation occurs only occasionally and generally in shallow layers or small nodules.

During drilling, a rock bit usually encounters stratas of abrasive and non-abrasive formations, as in the typical case of sand and shale sections. In general the degree of abrasive formation encountered will control the rate at which the inserts wear and since the inserts in the same annular row on the roller cutter are of generally the same hardness the wear will occur at roughly equal rates for all of the inserts in the row. As the inserts wear, their cutting efficiency becomes diminished, causing the drilling rate to decrease which will generally control the time at which the bit is replaced with a new sharp bit.

In most drilling situations the abrasive formations are encountered sequentially with less abrasive strata, such as the typical case of a sand-shale laminate section. In these cases, the more abrasive sand sections cause accelerated wear while little wear occurs in the less abrasive shales. Wear on the cutting surface of the insert will limit the bit's drilling rate even in the shale.

Prior art drill bits have disclosed composite inserts, using multiple grades of tungsten carbide in the fabrication of inserts in an attempt to create an abrasive resistant tough insert to reduce the wear or dulling of the insert cutting surface while maintaining toughness to prevent fracture. As examples of prior art drill bits having cutting elements or inserts formed of multiple grades of tungsten carbide, reference is made to U.S. Pat. Nos. 4,705,124; 4,722,405; and 4,694,918. Such prior art discloses cutting inserts in which the cutting surface uses a harder grade of tungsten carbide and grades to a softer material, or has a diamond layer for increased hardness. Also shown are cutting inserts formed of different grades of tungsten carbide material with the leading face of the insert using a softer tougher grade of tungsten carbide and the trailing face having a harder grade of tungsten carbide.

SUMMARY OF THE INVENTION

The present invention is particularly directed to a roller cutter drill bit in which the roller cutters have a plurality of cutting elements thereon arranged in a plurality of concentric annular rows. Each roller cutter has a generally frusto-conical body with a plurality of generally cylindrically shaped mounting sockets or openings therein which receive individual cutting elements or inserts for securing or mounting the cutting inserts on the body. The cutting inserts have outer projecting tips for engaging the formation in which the bore hole is drilled. At least the projecting tips of the cutting inserts are formed of a wear-resistant material and the projecting tips of at least 20% to 50% of the cutting inserts in at least one row are formed of a substantially harder wear-resistant material than the cutting tips of the remaining cutting inserts in such rows and are intermingled in a generally uniformly spaced predetermined pattern with the remaining cutting inserts. The cutting tips of the remaining cutting inserts have a wear-resistant material which is substantially tougher but softer than the tips of the other cutting inserts.

With this arrangement of alternating material properties of inserts in the same row, the versatility and the overall performance of the bit can be improved. By alternating hard inserts and softer inserts in the same row the inserts will undergo preferential wear with the softer inserts wearing away at a more rapid rate than the harder inserts during the encounter with abrasive formations. This preferential wear allows the bit to continue to penetrate at an economical drilling rate.

As the soft inserts wear away during drilling the harder inserts take over a larger percentage of the rock destruction leaving behind small uncut areas or kerfs of formation which are more easily removed or destroyed by the softer inserts. This reduces the amount of cutting accomplished by the softer inserts and thereby decreases the rate of wear of the softer inserts.

If an extremely hard and tough formation strata is encountered, the hard inserts may fracture and become ineffective. In this case the 50% or more softer tough inserts will allow the bit to continue drilling which would not be the case if all of the inserts were hard. This mixture of hard and soft inserts in the same row in a predetermined intermingled pattern allows less wear and more efficient drilling in abrasive formations and still allows the bit to continue drilling if an extremely hard tough strata of formation is encountered which fractures the hard inserts.

Cutting inserts for roller cutters have generally cylindrical bodies which fit within receiving sockets within the roller cutter body but the projecting tips have various shapes and various projecting lengths depending primarily on the type of formation to be encountered. Normally, relatively short length rounded tips are used in drilling the hardest formations while relatively long chisel-shaped tips are used in drilling of softer formations. Conically-shaped tips are utilized in various formations and particularly medium hardness formations. The cutting inserts of the present invention which have cutting surfaces of a harder material may have a blunter shape which is less susceptible to fracture than the more aggressive sharper shapes used in the inserts having softer tougher cutting surfaces. Also, the hard cutting inserts may be either formed of a hard homogeneous material, or formed of a hard cutting surface with the remainder of the insert being of a softer tougher material. Several transition layers may be provided, if desired, between the hard outer cutting surface and the softer material of the body of the cutting insert.

It is an object of this invention to provide a roller cutter drill bit with a plurality of generally frusto-conical roller cutters in which cutting inserts are arranged in concentric annular rows on the roller cutters with selected cutting inserts in at least one row having cutting surfaces thereon of a substantially harder wear-resistant material than the cutting surfaces of the remaining cutting inserts and intermingled in a generally uniformly spaced predetermined pattern with the remaining softer cutting inserts thereby to provide a long wearing drill bit when both hard and soft formations are encountered.

It is a further object of this invention to provide such a roller cutter with an annular row of such cutting inserts in which selected cutting inserts have tips thereon of a shape and projecting length different from the shape and projecting length of the remaining cutting inserts in the row and are intermingled in a generally uniformly spaced predetermined pattern with the remaining cutting elements.

Other objects and features will be in part apparent and in part pointed out hereinafter.

DESCRIPTION OF THE INVENTION

Figure 1:
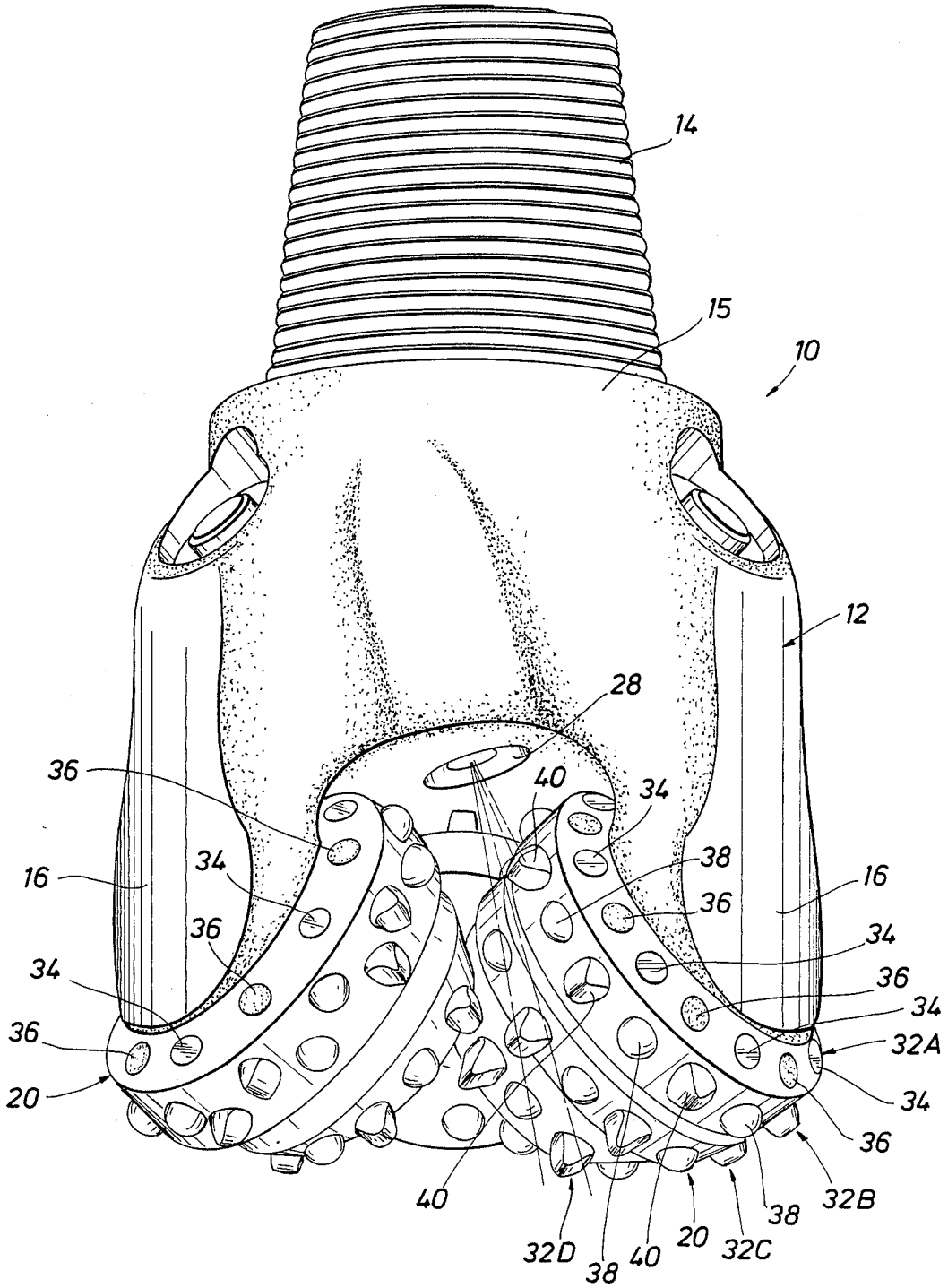
FIG. 1 is a perspective of a roller cutter drill bit comprising the present invention in which selected cutting inserts have tips of a harder wear-resistant material than the tips of the remaining cutting inserts and are intermingled with the remaining cutting inserts in a generally uniformly spaced predetermined pattern.
Figure 2:
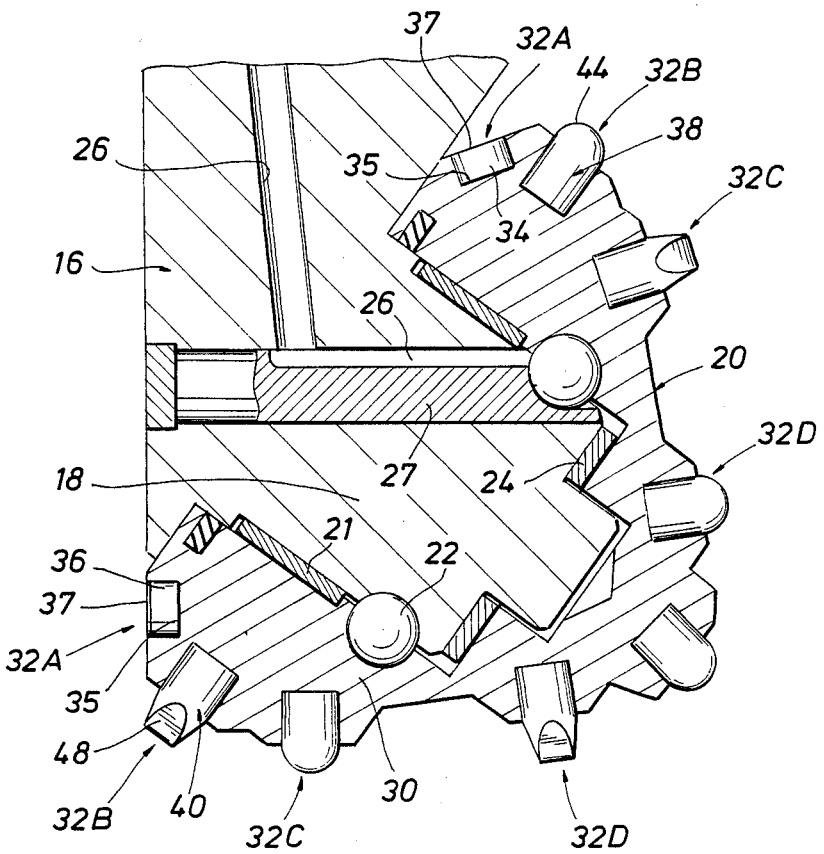
FIG. 2 is an enlarged sectional view of a roller cutter shown in FIG. 1 mounted on a journal for rotation and having a plurality of cutting inserts comprising the present invention thereon.

Referring to FIGS. 1 and 2, a roller cutter drill bit in accordance with this invention is shown at 10 and has a main bit body 12 with an upwardly extending threaded pin 14 adapted to be connected to a drill string for rotation. Main body 12 is formed from three integral lugs to define an upper shank 15 below pin 14 and three downwardly extending legs 16. Each leg 16 has a journal 18 on its extending end and a roller cutter generally designated 20 is mounted for rotation on journal 18 about bushing 21, ball bearings 22, and end thrust bearing 24. Lubricant is supplied to the bearing areas from a lubricant supply (not shown) through lubricant channels 26. A retainer 27 is positioned adjacent ball bearings 22 for holding bearings 22 in position.

A nozzle indicated generally at 28 is provided at the juncture of adjacent legs 16 and a stream of pressurized drilling fluid is discharged therefrom at an angled relation relative to the rotational axis of bit 10 for first impinging against a leading roller cutter 20, and then the bottom of the bore hole for scouring the bore hole bottom immediately in advance of leading roller cutter 20 engaging the formation in a cutting action.

Roller cutter 20 has a frusto-conical body 30 with cutting elements or inserts arranged thereon in a plurality of concentric annular rows indicated at 32A, 32B, 32C and 32D. Row 32A is a reaming insert row or so-called "G" row and includes a plurality of cylindrical cutting inserts or discs 34 and 36 which are secured by press fitting within similarly shaped sockets 35 in body 30 so that a substantially flush outer cutting face 37 is provided with the outer surface of body 30 for engaging the side wall surface of the bore hole and extending in a plane generally at right angles to the bottom of the bore hole. Inserts 34 are formed of tungsten carbide and inserts 36 have a tungsten carbide body with the outer cutting face of the body having a diamond layer, such as a polycrystalline diamond layer having a thickness of 300 microns. Thus, the cutting surfaces of inserts 36 have a wear resistance material thereon of a hardness substantially greater than the hardness of the cutting surfaces of tungsten carbide inserts 34.

It may be desirable under certain operating conditions and formations encountered to have inserts 36 formed of tungsten carbide of a harder grade such as 1700 DPH (diamond pyramid hardness with a 10KG indentor), than the tungsten carbide from which inserts 34 are formed in order to provide increased hardness. Inserts 34 may be formed, for example, of a softer but tougher grade of tungsten carbide, such as 1200 DPH.

As a specific example, inserts 34 may be formed of Firth Sterling grade H-71 of tunsten carbide while inserts 36 may be formed of Firth Sterling grade H-6 of tungsten carbide. Inserts 34 and 36 are illustrated in row 32A of FIG. 1 in an alternating pattern in equal numbers with inserts 34 defining alternate inserts and inserts 36 defining intervening inserts. Row 32A maintains the gage or diameter of the bore hole along with the adjacent gage row 32B.

Figure 3:
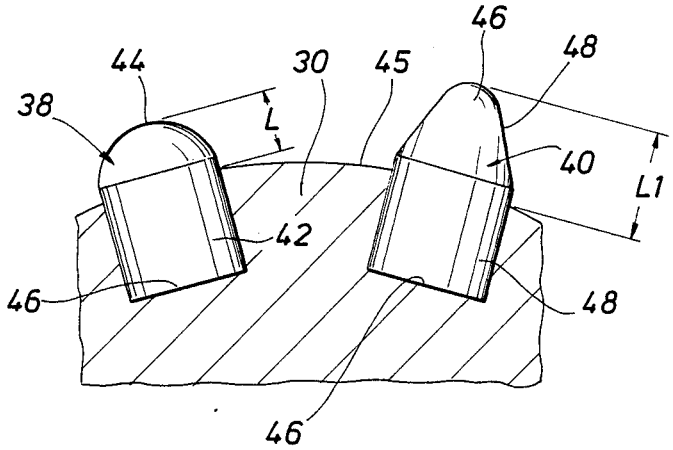
FIG. 3 is an enlarged sectional view of two adjacent cutting inserts in a row with the projecting tips of the cutting inserts formed of different hardnesses and having different shapes.

Referring now to row 32B which is the so-called "gage" row, cutting inserts are illustrated in an alternating pattern comprising alternate inserts 38 and the remaining intervening inserts 40. Referring to FIG. 3, an alternate insert 38 is shown adjacent an intervening insert 40. Alternate insert 38 has a cylindrical body 42 and a projecting end or tip 44 extending outwardly from the outer surface 45 of a cutter body 30. The end of tip 44 is rounded and formed of a hard grade tungsten carbide to provide a hard cutting surface for engaging relatively hard formations. The major portion of the length of cylindrical body 42 is received within a generally cylindrical receiving socket 46 in which insert 38 is press fitted. Cutting insert 38 projects a length L from outer surface 45 of cutter body 12 as shown in FIG. 3. Cutting insert 38 is formed of an outer rounded tip 44 which provides a cutting surface. Insert 40 has a chisel-like projecting end or tip 46 forming an outer cutting edge 48. Cutting insert 40 projects a length L1 from outer surface 45 of body 12. Insert 38 may be formed of a material having homogeneous properties throughout such as a hard tungsten carbide material while inserts 40 may be formed of a softer but tougher tungsten carbide material not as brittle as the tungsten carbide material from which inserts 38 are formed and therefor not as susceptible to fracture.

As an example, inserts 38 may be formed of a homogeneous material providing homogeneous properties and having a diamond pyramid hardness (DPH) from 1,400 to 5,000. Inserts 40 may be formed of a soft material having a hardness from 800 DPH to around 1,300 DPH. Polycrystalline diamonds have a hardness of around 6,500 DPH to 8,500 DPH. Rows 32C and 32D are likewise formed of hard and soft inserts in a predetermined pattern in which the hard inserts are intermingled in the rows with the soft inserts in a generally uniformly spaced relation.

Hard inserts 38 are shown in the drawings as comprising 50% of the total inserts in annular row 32B and for best results it is desirable that inserts 38 not comprise over around 50% of the total inserts in a particular row in order to provide a maximum life for rotary drill bits which encounter formation stratas of abrasive and non-abrasive formations as in the typical case of sand and shale sections. The more abrasive sand sections accelerate wear while little wear occurs in the less abrasive shale sections. A very hard formation encountered such as chert, is tough to crack or fracture and may cause a fracture problem with the hard brittle inserts, but usually a very hard formation is encountered only occasionally and does not form the major portion of formations encountered. Thus, a relatively small number of hard tungsten carbide inserts may be utilized in many instances, such as comprising only around 25% or ¼ of the total inserts in a row but intermingled in a generally uniformly spaced predetermined pattern with the softer or tougher inserts as shown in 40.

Figure 4:
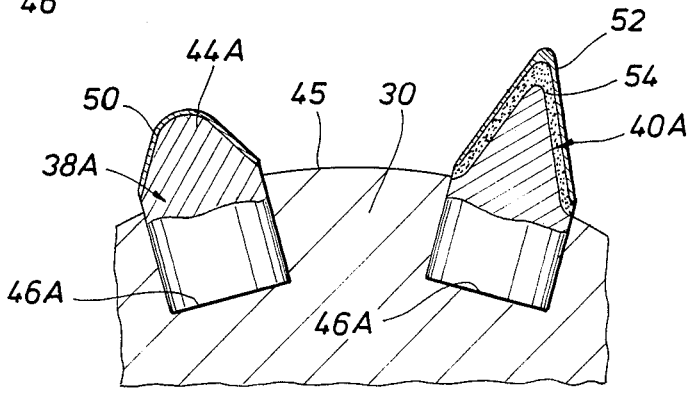
FIG. 4 is an enlarged sectional view of two modified adjacent cutting inserts in a row with the projecting tips of the cutting inserts formed of different hardnesses and having different shapes.

Referring to FIG. 4, modified inserts are illustrated in which inserts 38A and 40A press fitted within sockets 46A are formed of materials not having homogeneous properties. As shown, insert 38A has outer tip 44A formed of a layer of material shown at 50. Layer 50 may be formed of various types of materials, such as, for example, a diamond layer, a layer of cubic boron-nitride, a layer of polycrystalline diamond and cemented tungsten carbide, or a hard tungsten carbide layer. The layer may have homogeneous properties, or if desired may be provided with non-homogeneous properties such as a hard tungsten carbide material having a hardness of 1700 DPH for the cutting surface grading to a tough tungsten carbide material having a hardness of 1200 DPH for the remainder of the insert. If separate layers are not provided, the inserts if formed of a homogeneous material will not have a hardness more than around 1,800 DPH. However, when hard layers are utilized, the hardness may be up to around 2000 DPH, and with a diamond layer, the hardness may be from 6,500 to 8,500 DPH. Insert 40A is also provided with an outer layer 52 of a hardness less than the hardness of layer 50 of insert 38A but harder than the body of insert 40A. In addition, a transition layer 54 is shown in which a property gradient of tungsten carbide is provided. Thus, insert 40A is not formed of a homogeneous material.

While it is desirable that all of the annular rows 32A, 32B, 32C and 32D be provided with cutting inserts having selected inserts arranged in a predetermined intermingled generally uniformly spaced pattern with the remaining inserts, it is more important that the larger diameter rows, particularly the gage row, be provided with such an intermingled pattern of hard and soft inserts in order to provide a long lasting rotary drill bit. It is apparent that different hardnesses for the cutting surfaces of inserts may be obtained in a variety of methods as indicated above. Also, the layer of hard material at the cutting surface for an insert may have property gradients from hard and brittle at the outer cutting surface to soft and tough in the remainder of the insert. The property gradients may be continuous or may may be provided in a series of distinct steps or separate transition layers having relatively small thicknesses. A composite of diamond crystals and precemented tungsten carbide may be provided in a transition layer with the proportion of diamond crystals and tungsten carbide being varied in distinct steps or in a gradual transition across the entire thickness of the entire layer of hard material formed on the tips of the cutting inserts.

When such a hard material is formed on the cutting tip of the cutting insert, it is desirable that the body of the insert be formed of a softer or tougher material so that it will not be too susceptible to fracture as is a hard brittle material. Thus, the body of the insert is normally formed of a tungsten carbide material having a hardness between 800 and 1,300 DPH when the cutting tip thereof has an outer hard layer thereon. When such an outer layer is provided utilizing polycrystalline diamonds, the so-called PCD layer may have a thickness of about 300 microns although thicker or thinner layers between around 50 and 5000 microns in thickness may be employed.

An example of a drilling application in which rotary drill bits have not performed entirely satisfactory is in drilling the Travis Peak formations encountered in North Louisiana. This formation has varied thickness layers of hard sandstone and shale. The formations are generally overbalanced which makes drilling the shale difficult with a blunt or dull insert bit. Also, the hard sandstone can quickly dull an aggressive cutting structure. Depending on the expected amount of hard sand through a section to be drilled, either a blunt hard tungsten carbide insert bit could be used, or a more aggressive insert bit with softer tougher inserts may be used. Of course, the blunt hard carbide bit is utilized where a significant amount of hard sand is expected. If, however, it is found that the formation does not contain a significant amount of hard sand then the rate of penetration will be slow. The present invention has been found to be effective with such a formation as indicated above as the hard inserts will be particularly effective with hard sandstone while the soft inserts will be particularly effective with the shale.

In view of the above, it will be seen that the several objects of the invention are achieved and other advantageous results obtained.

As various changes could be made in the above constructions without departing from the scope of the invention, it is intended that all matter contained in the above specification or shown in the accompanying drawings shall be interpreted as illustrative and not in a limiting sense.

What is claimed is:

1. A rotary drill bit for drilling a well bore hole and comprising:

a bit body having an upper end adapted to be detachably secured to a drill string for rotation of the drill bit, and at least one depending leg at its lower end having a generally cylindrical bearing journal;

a roller cutter mounted for rotation on said journal and having a generally frusto-conical body defining a generally frusto-conical body defining a generally frusto-conical outer surface; and a plurality of cutting inserts arranged in a plurality of spaced concentric annular rows on said body, said cutting inserts having outer cutting surfaces formed of a wear-resistant material and adapted to bear on the formation of the well bore hole for drilling the bore hole, each of said annular rows having a plurality of cutting inserts therein spaced from each other;

one of said rows of cutting elements being a reaming insert row positioned adjacent a gage row of cutting elements and adapted to engage the cylindrical side wall of the bore hole for maintaining the diameter of the bore hole, said reaming insert row comprising a plurality of spaced cutting elements each having a generally planar cutting face substantially flush with the adjacent outer surface of the cutter body and extending in a plane generally at right angles to the bottom of the bore hole for engaging the side wall surface of the bore hole;

at least some of the cutting surfaces of the cutting inserts in said reaming insert row being formed of a substantially harder wear-resistant material than the cutting surfaces of the remaining cutting inserts in said reaming insert row and intermingled in a generally uniformly spaced pattern with said remaining cutting inserts, the cutting surfaces of said remaining cutting elements being substantially tougher than the cutting surfaces of said cutting inserts having the substantially harder wear-resistant material whereby said reaming insert row of cutting inserts has cutting surfaces formed of predetermined different physical properties and intermingled in a predetermined pattern for increasing the life of the bit when different types of formations are encountered.

2. A rotary drill bit as set forth in claim 1 wherein said cutting surfaces of said reaming insert row having the substantially harder wear-resistant material thereon are formed of a polycrystalline diamond layer and the cutting surfaces of the remaining cutting inserts in said reaming insert row are formed of tungsten carbide.

* * * * *